US009145218B2

(12) United States Patent
Monti

(10) Patent No.: US 9,145,218 B2
(45) Date of Patent: Sep. 29, 2015

(54) APPARATUS FOR INSERTING ARTICLES INTERNALLY OF BOXES

(71) Applicant: Marchesini Group S.p.A., Pianoro (Bologna) (IT)

(72) Inventor: Giuseppe Monti, Pianoro (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 468 days.

(21) Appl. No.: 13/728,039

(22) Filed: Dec. 27, 2012

(65) Prior Publication Data

US 2013/0180207 A1 Jul. 18, 2013

(30) Foreign Application Priority Data

Jan. 16, 2012 (IT) ..... BO2012A0015

(51) Int. Cl.

| | |
|---|---|
| ***B65B 5/00*** | (2006.01) |
| ***B65B 35/40*** | (2006.01) |
| ***B65B 65/02*** | (2006.01) |
| ***B65B 5/06*** | (2006.01) |

(52) U.S. Cl.

CPC ..... *B65B 5/00* (2013.01); *B65B 35/405* (2013.01); *B65B 5/06* (2013.01); *B65B 65/02* (2013.01)

(58) Field of Classification Search

CPC ..... B65J 9/10; B65B 35/20; B65B 35/205; B65B 35/40; B65B 35/405

USPC ..... 53/251, 252, 255; 414/744.5

See application file for complete search history.

(56) References Cited

U.S. PATENT DOCUMENTS

| | | | | |
|---|---|---|---|---|
| 2,029,935 | A * | 2/1936 | Milmoe | 53/73 |
| 4,969,313 | A * | 11/1990 | Nonini et al. | 53/537 |
| 5,079,896 | A * | 1/1992 | Langen et al. | 53/54 |
| 5,175,976 | A * | 1/1993 | Petry et al. | 53/252 |
| 5,457,935 | A * | 10/1995 | Kope | 53/258 |
| 6,481,309 | B2 * | 11/2002 | Mitsuyoshi | 74/490.01 |
| 7,572,093 | B2 * | 8/2009 | Minami et al. | 414/744.5 |
| 8,083,659 | B2 * | 12/2011 | Monti | 493/163 |
| 2010/0307107 | A1 * | 12/2010 | Behringer | 53/266.1 |

FOREIGN PATENT DOCUMENTS

| | | |
|---|---|---|
| EP | 0464002 A1 | 1/1992 |
| EP | 2112071 A1 | 10/2009 |

OTHER PUBLICATIONS

European Search Report for corresponding application No. EP12197544, completed Apr. 4, 2013, 3 pages.

* cited by examiner

*Primary Examiner* — Stephen F Gerrity
*Assistant Examiner* — Patrick Fry
(74) *Attorney, Agent, or Firm* — R. Neil Sudol; Henry D. Coleman

(57) ABSTRACT

An apparatus for inserting articles into boxes has a frame positionable by a side of a first conveyor, a first thrust plat, a first abutting blade, and a first hinged member. The apparatus has second, third, fourth, fifth, sixth, seventh and eighth hinged members. First and second linear motors are borne by the fifth hinged member. A first rod fixed to the first thrust plate is moved by the first linear motor a horizontal and perpendicular direction. A second rod fixed to the first abutting blade is moved by the second linear motor in a horizontal and perpendicular direction. The first hinged member and the third hinged member are rotated to move the fifth hinged member in synchrony with the first conveyor and with a second conveyor (6), to move the first thrust plate and the first abutting blade to introduce an article into a box.

4 Claims, 9 Drawing Sheets

APPARATUS FOR INSERTING ARTICLES INTERNALLY OF BOXES

FIELD OF THE INVENTION

The present invention relates to the technical sector concerning apparatus for inserting articles, such as blister packs containing tablets, internally of boxes.

DESCRIPTION OF THE PRIOR ART

An apparatus of known type for inserting articles internally of boxes is arranged by a side of a first conveyor which moves the articles in an advancement direction and in a horizontal advancement direction; the first conveyor is of the belt type and transports, on the relative upper branch, the articles, for example blister packs containing tablets. The belt of the first conveyor is provided with pairs of lateral walls which each define a housing compartment for one or more articles stacked on one another.

A second conveyor is arranged by a side of the first conveyor, which second conveyor moves boxes in the same sense and advancement direction as the first conveyor; the second conveyor is a conveyor belt and transports, on the upper branch thereof, empty boxes destined to be filled with the articles transported by the first conveyor. The belt of the second conveyor is provided with pairs of lateral walls which define abutments each for maintaining a box to be filled in position.

The apparatus is activated in synchrony with the first conveyor and with the second conveyor for inserting an article, or a stack of articles, internally of a box.

The apparatus comprises: a thrust plate for pushing an article, arranged in the housing compartment of the belt of the first conveyor, internally of a box arranged on the belt of the second conveyor; and an abutting blade destined to at least partly enter the box and provide an upper abutment for facilitating the insertion of the article internally of box. The presence of the abutting blade is necessary where the articles have a limited resistance to buckling and might arch during the action of the thrust plate: an example of this type of article is the blister pack containing tablets.

The thrust plate and the abutting blade are activated by cam mechanisms having various drawbacks: in fact, the cam mechanisms have a high number of components, are complicated to regulate and are voluminous.

SUMMARY OF THE INVENTION

The aim of the present invention consists in obviated the above-cited drawbacks.

The above aim is obtained with an apparatus for inserting articles internally of boxes, which apparatus is positionable by a side of a first conveyor which moves articles in an advancement direction and in a horizontal advancement direction. The apparatus can operate in synchrony with the first conveyor and with a second conveyor which is arranged by a side of the first conveyor and which moves boxes in a same sense and advancement direction as the first conveyor. The apparatus has a first thrust plate for pushing at least an article internally of a box, and a first abutting blade for at least partially entering the box and providing an upper abutment for facilitating insertion of the article in the box. The apparatus has a first member which is hinged to the frame at a first hinge axis, a second member that is hinged to the first member at a second hinge axis, a third member that is hinged to the frame at the first hinge axis, a fourth member which is hinged to the second member at a third hinge axis and to the third member at a fourth hinge axis. The first member, the second member, the third member and the fourth member define a first four-bar linkage. A fifth member is hinged to the fourth member and to the second member at the third hinge axis. A sixth member is hinged to the fifth member at a fifth hinge axis. A seventh member is hinged to the sixth member at a sixth hinge axis and to the fourth member and to the third member at the fourth hinge axis. The fourth member, the fifth member, the sixth member and the seventh member define a second four-bar linkage. An eighth member is hinged to the frame at a seventh hinge axis and to the seventh member at an eighth hinge axis. The first hinge axis, the second hinge axis, the third hinge axis, the fourth hinge axis, the fifth hinge axis, the sixth hinge axis, the seventh hinge axis and the eighth hinge axis are horizontal and perpendicular to the advancement direction. The apparatus is positionable with respect to the first conveyor such that the second member is downstream of the third member with respect to the advancement direction. A first linear motor is borne by the fifth member, and a second linear motor is borne by the fifth member. A first rod is fixed to the first thrust plate and is moved by the first linear motor so as to move with an alternating motion in a horizontal and perpendicular direction to the advancement direction. A second rod is fixed to the first abutting blade and is moved by the second linear motor in order to move with an alternating motion in a horizontal and perpendicular direction relative to the advancement direction. The first member and the third member are activatable in rotation to move the fifth member in synchrony with the first conveyor and with the second conveyor and enable movement of the first thrust plate and the first abutting blade respectively by means of the first linear motor and the second linear motor in order to introduce at least an article internally of a box.

The combined use of four-bar linkages and linear motors for moving the first thrust plate and the first abutting blade has been seen to be particularly advantageous and has enabled the prefixed aim to be attained.

BRIEF DESCRIPTION OF THE DRAWINGS

Specific embodiments of the invention will be described in the following description, in accordance with what is set out in the claims and with the aid of the accompanying tables of drawings, in which:

DESCRIPTION OF PREFERRED EMBODIMENTS

Figure 1:
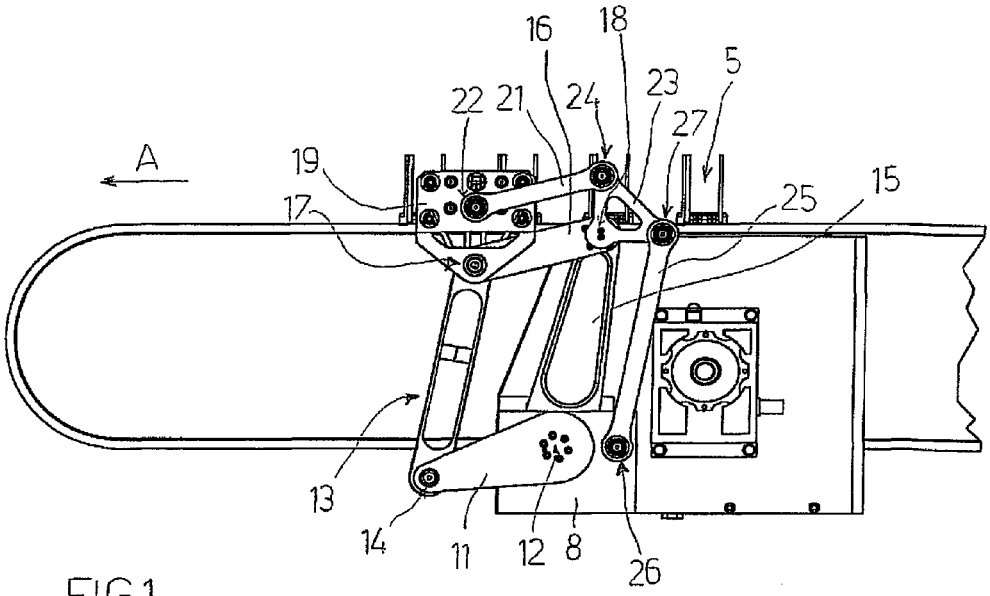
FIGS. 1, 2, 3 are respectively a lateral view, a front view and a perspective view of the apparatus of the present invention, in a first operating step.

With reference to the accompanying figures of the drawings, reference numeral (1) denotes in its entirety the apparatus for inserting articles internally of boxes, object of the present invention.

The apparatus is positionable by a side of a first conveyor (2) which moves articles (3) in an advancement direction (A) and in a horizontal advancement direction; the first conveyor (2) can be of the conveyor belt type and can transport the articles (3) on the upper branch thereof. The belt of the first conveyor (2) can be provided with parts of lateral walls (4) which each define a housing compartment (5) for one or more articles (3) stacked on one another (in the example two blister packs (3) of tablets). In the illustrated example in the figures, each housing compartment (5) receives to blister packs (3) of tablets, which packs are stacked one on another.

A second conveyor (6) can be arranged by a side of the first conveyor (2), which second conveyor (6) moves boxes (7) in a same advancement sense and direction as the first conveyor (2); the second conveyor (6) can be a conveyor belt and can transport empty boxes (7) on the upper branch thereof, which empty boxes (7) are destined to be filled with the articles (3) transported by the first conveyor (2). The belt of the second conveyor (6) can be provided with pairs of lateral walls (4) (not illustrated) which define abutments for each maintaining a box (7) to be filled in position. A fixed abutment can also be provided (not illustrated) positioned by a side of the second conveyor (6) for abutting the bottom of the boxes (7), such that the boxes (7) remain in position for example during the inserting of the blister packs (3) internally thereof.

The apparatus (1) is activatable in synchrony with the first conveyor (2) and with the second conveyor (6) in order to introduce an article (3), or a stack of articles (3) internally of a box (7).

The apparatus (1) comprises: a frame (8); a first thrust plate (9) for pushing at least an article internally of a box (7); and a first abutting blade (36) for at least partially entering the box (7) and providing an upper abutment for facilitating insertion of the article (3) in the box (7).

As mentioned herein above, the presence of the first abutting blade (36) is necessary when the articles (3) have a limited resistance to buckling and might arch during the action of the first thrust plate (9); an example of articles (3) of this type are indeed blister packs (3) containing tablets, illustrated in the accompanying figures, but might also be soft packs containing liquid, granular or powder substances.

The apparatus (1) further comprises: a first member (11) which is hinged to the frame (8) at a first hinge axis (12); a second member (13) that is hinged to the first member (11) at a second hinge axis (14); a third member (15) that is hinged to-the frame (8) at the first hinge axis (12); a fourth member (16) which is hinged to the second member (13) at a third hinge axis (17) and is hinged to the third member (15) at a fourth hinge axis (18); the first member (11), the second member (13), the third member (15) and the fourth member defining a first four-bar linkage; a fifth member (19) which is hinged to the fourth member (16) and to the second member (13) at the third hinge axis; a sixth member (21) which is hinged to the fifth member (19) at a fifth hinge axis (22); a seventh member (23) which is hinged to the sixth member (21) at a sixth hinge axis (24) and which is hinged to the fourth member (16) and to the third member (15) at the fourth hinge axis (18); the fourth member (16), the fifth member (19), the sixth member (21) and the seventh member (23) defining a second four-bar linkage; an eighth member (25) which is hinged to the frame (8) at a seventh hinge axis (26) and which is hinged to the seventh member (23) at an eighth hinge axis (27); the first hinge axis (12), the second hinge axis (14), the third hinge axis (17), the fourth hinge axis (18), the fifth hinge axis (22), the sixth hinge axis (24), the seventh hinge axis (26) and the eighth hinge axis (27) being horizontal and perpendicular to the advancement direction.

The apparatus (1) is positionable with respect to the first conveyor (2) such that the second member (13) is downstream of the third member (15) with respect to the advancement direction (A).

The apparatus (1) further comprises a first linear motor (28) which is borne by the fifth member (19); a second linear motor (29) which is borne by the fifth member (19); a first rod (37) which is fixed to the first thrust plate (9) and which is moved by the first linear motor (28) such as to move with an alternating motion in a horizontal and perpendicular direction to the advancement direction; a second rod (39) which is fixed to the first abutting blade (36) and which is moved by the second linear motor (29) in order to move with an alternating motion in a horizontal and perpendicular direction to the advancement direction; the first member (11) and the third member (15) being activatable in rotation to move the fifth member (19) in synchrony with the first conveyor (2) and with the second conveyor (6) and enable movement of the first thrust plate (9) and the first abutting blade (36) respectively by means of the first linear motor (28) and the second linear motor (29) in order to introduce at least an article (3) internally of a box (7).

The first four-bar linkage is a parallelogram linkage.

The second four-bar linkage can be a parallelogram linkage.

The fifth member (19) forms a housing (20); the first linear motor (28) and the second linear motor (29) are housed internally of the housing (20) of the fifth member (19).

The appended figures illustrate an operating cycle of the apparatus (1) of the invention, which is done in synchrony with the functioning of the first conveyor (2) and the second conveyor (6).

Figure 2:
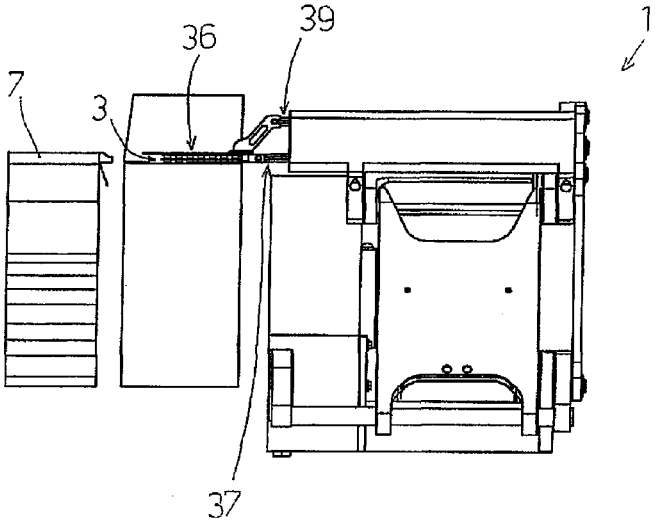
Figure 3:
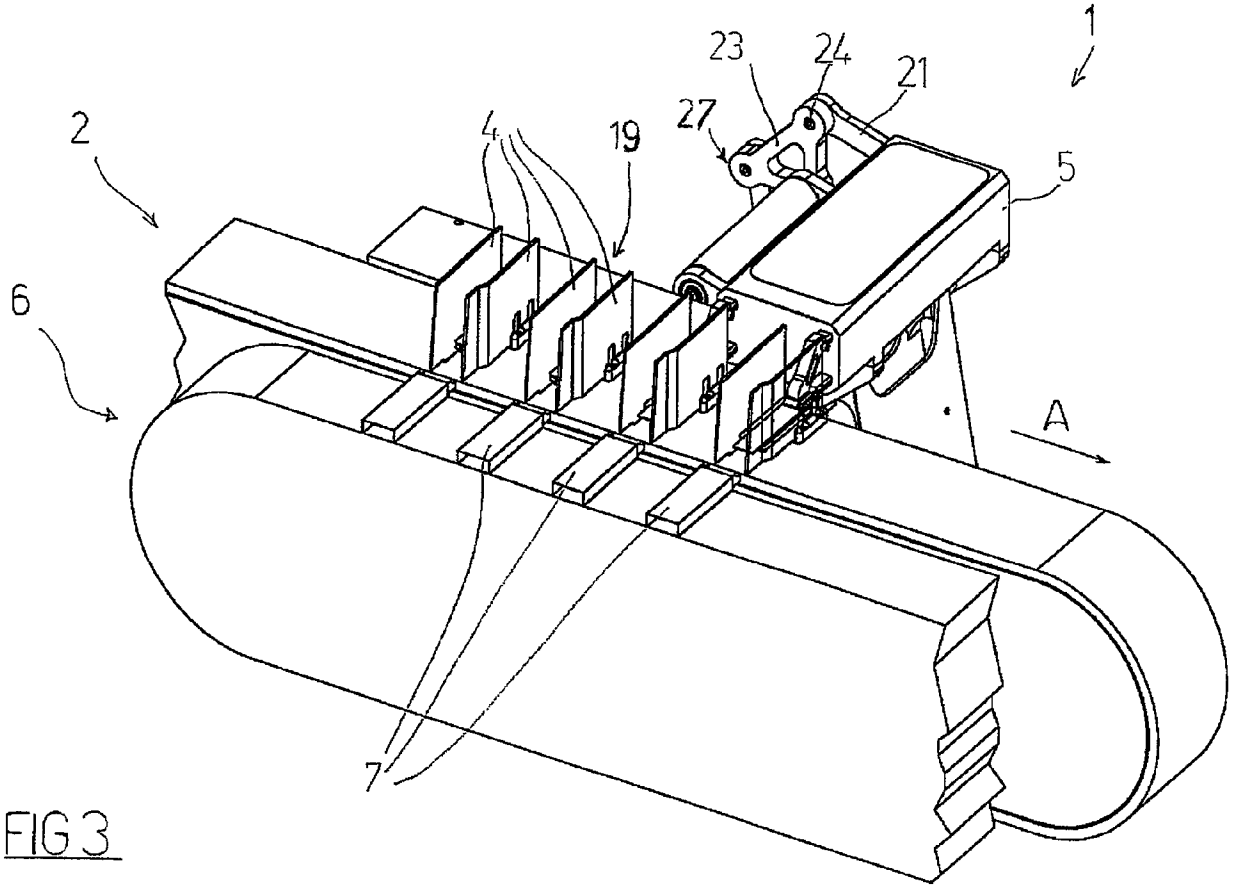
Figure 4:
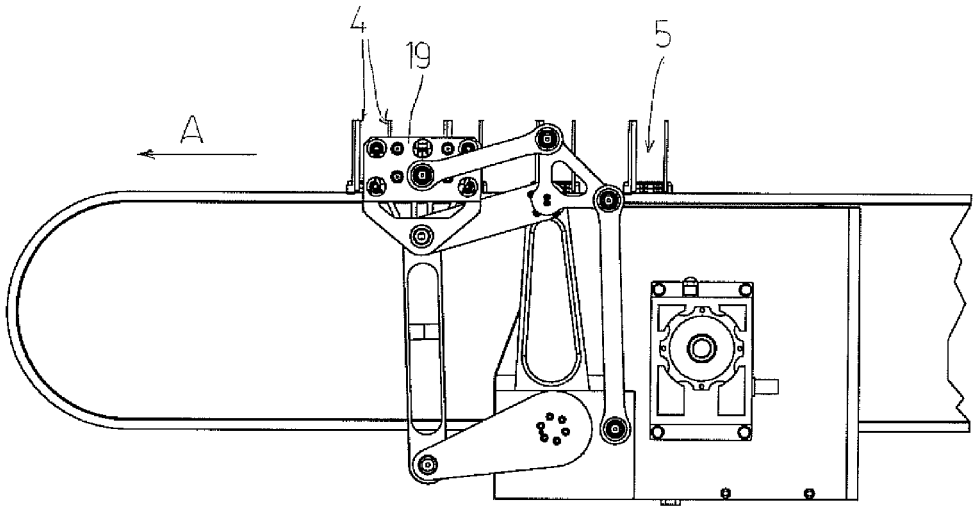
FIGS. 4, 5, 6, 7 are respectively a lateral view, a front view, a first perspective view and a second perspective view of the apparatus of the present invention, in a second operating step.
Figure 5:
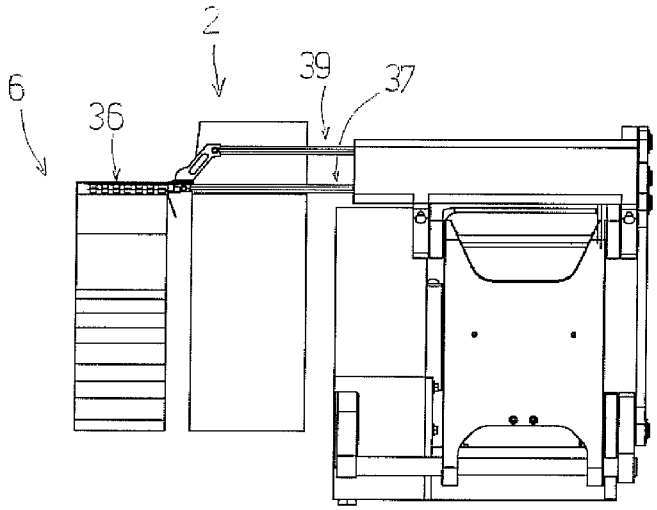
Figure 6:
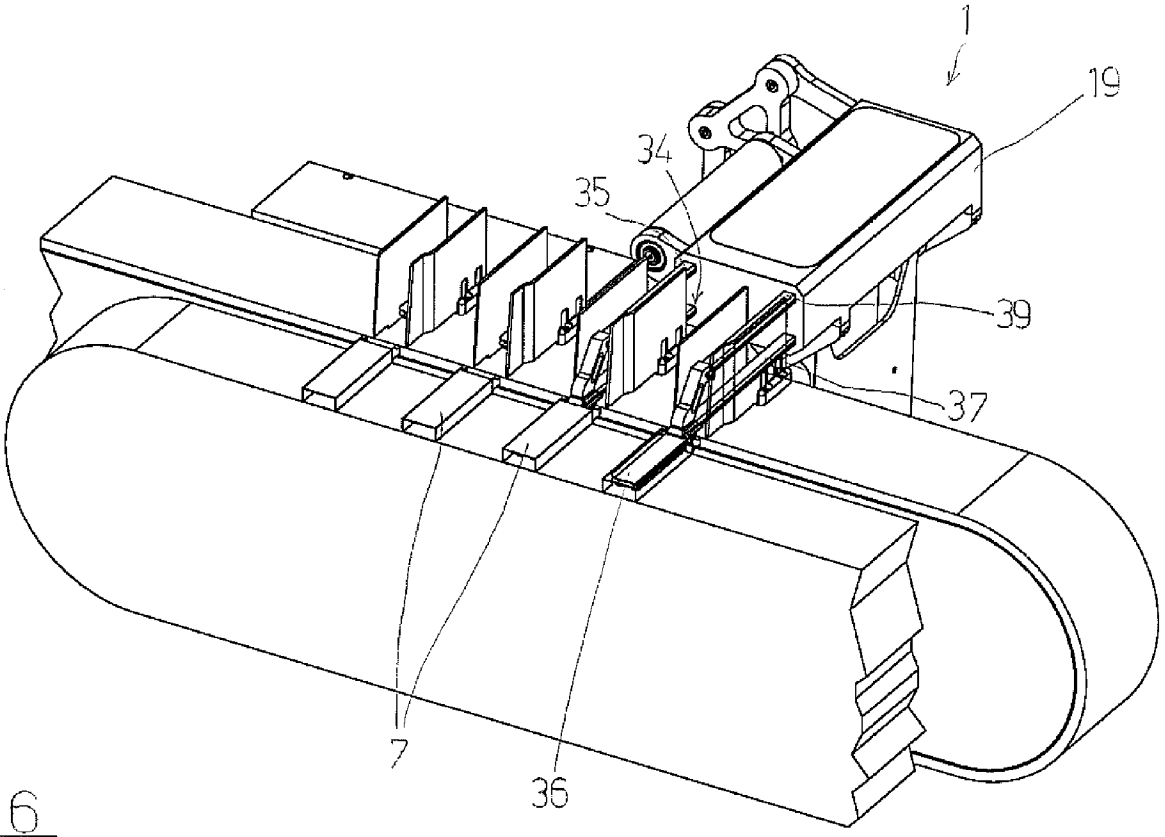
Figure 7:
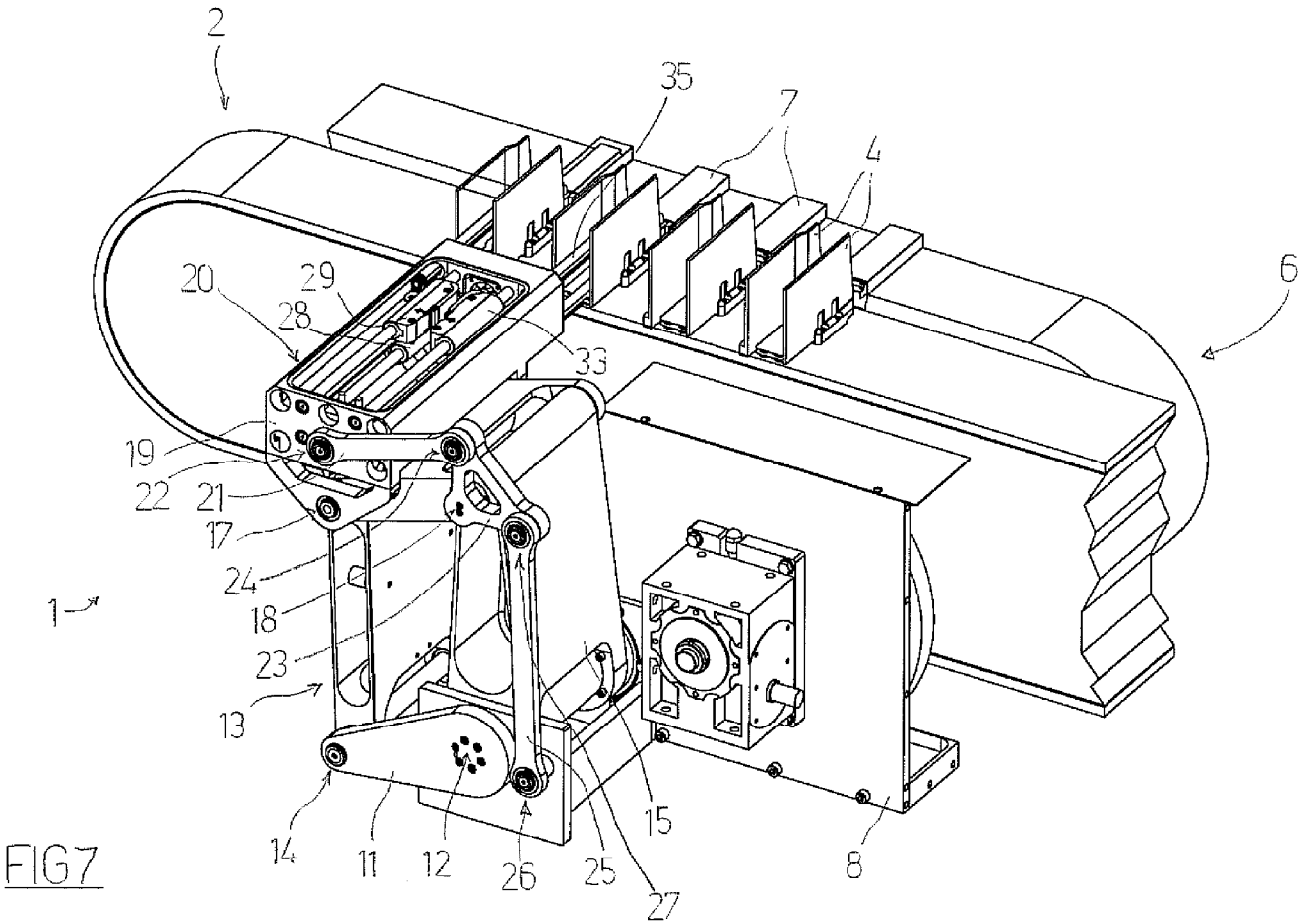

FIGS. 1-3 show a first operating step of the apparatus (1), in which the first blade is interposed between a pair of lateral walls (4) of the first conveyor (2) and is arranged above a pair of stacked blister packs (3).

The first thrust plate (9) and the first abutting blade (36) are then activated respectively to push the pair of blister packs (3) internally of a corresponding empty box (7) and to supply a constant upper abutment for the pair of blister packs (3) with the aim of ensuring insertion thereof into the box (7), see FIGS. 4-7 (second operating step). The first abutting blade (36) thus prevents the pair of blister packs (3) from arching, which might compromise insertion of the pair of blister packs (3) into the box (7). A rest plane, not illustrated, is provided between the first conveyor (2) and the second conveyor (6), to enable transfer of the pair of blister packs (3) from the housing compartment (5) of the first conveyor (2) to the box (7) which is on the second conveyor (6).

Figure 8:
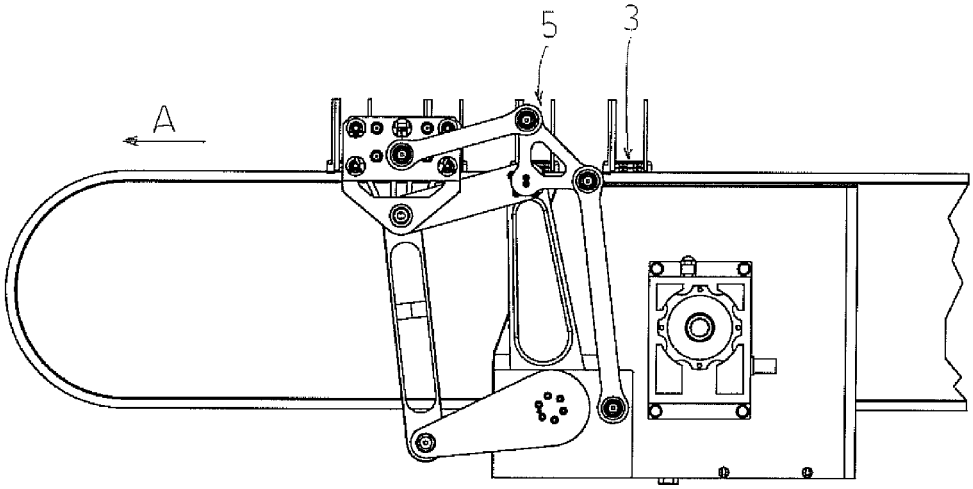
FIGS. 8, 9, 10 are respectively a lateral view, a front view and a perspective view of the apparatus of the present invention, in a third operating step.
Figure 9:
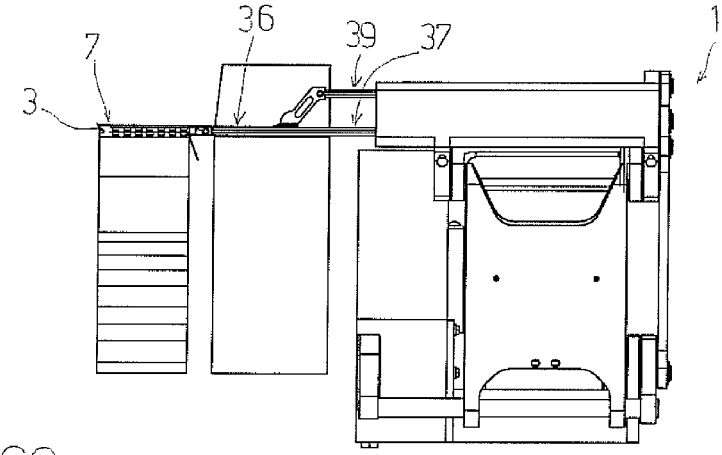
Figure 10:
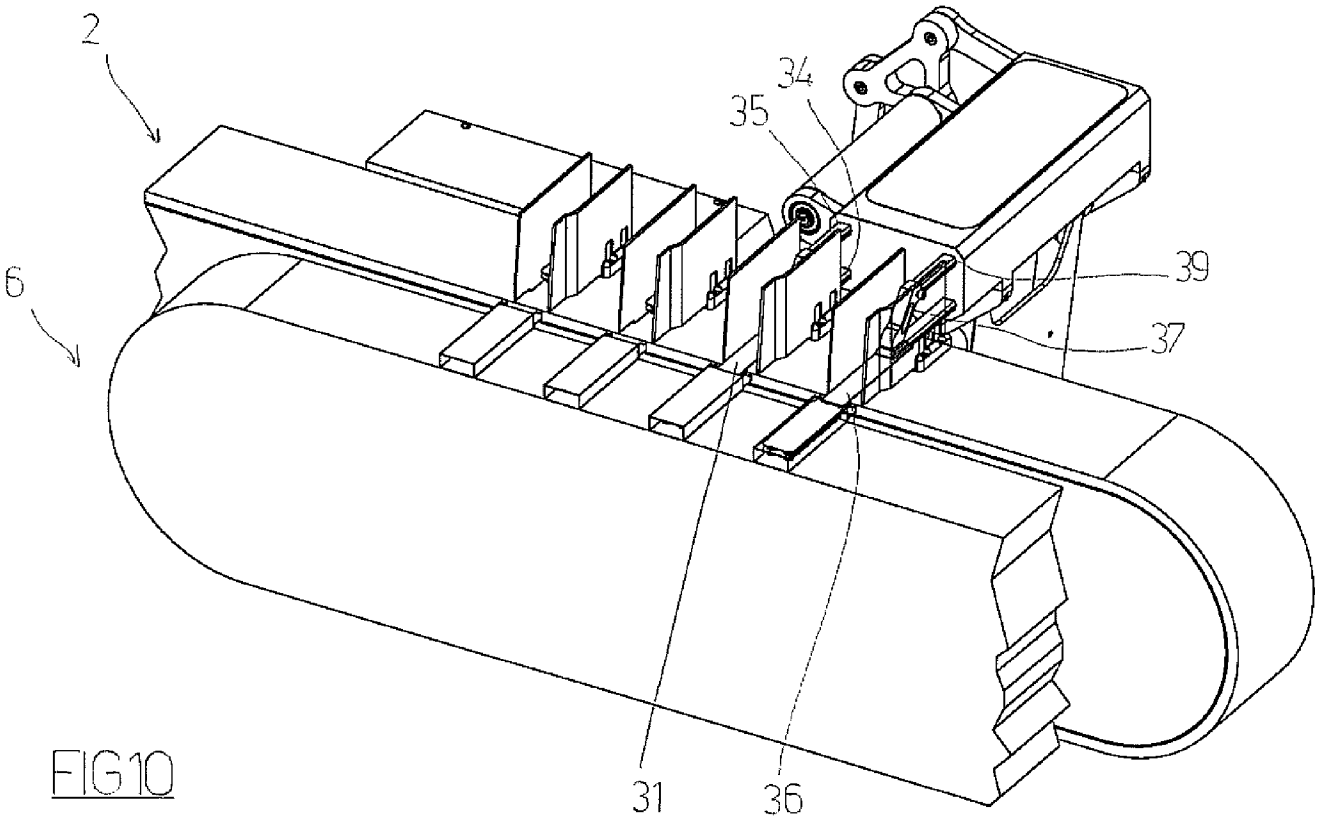

Once the pair of blister packs (3) has been inserted into the box (7), the first abutting blade (36) is made to retract such as to exit from the box (7) while the first thrust plate (9) is maintained in position such as to abut the pair of blister packs (3) internally of the box (7) and prevent the exit of the first abutting blade (36) from accidentally inducing an exit, even partial, of the pair of blister packs (3); see FIGS. 8-10, third operating step.

Figure 11:
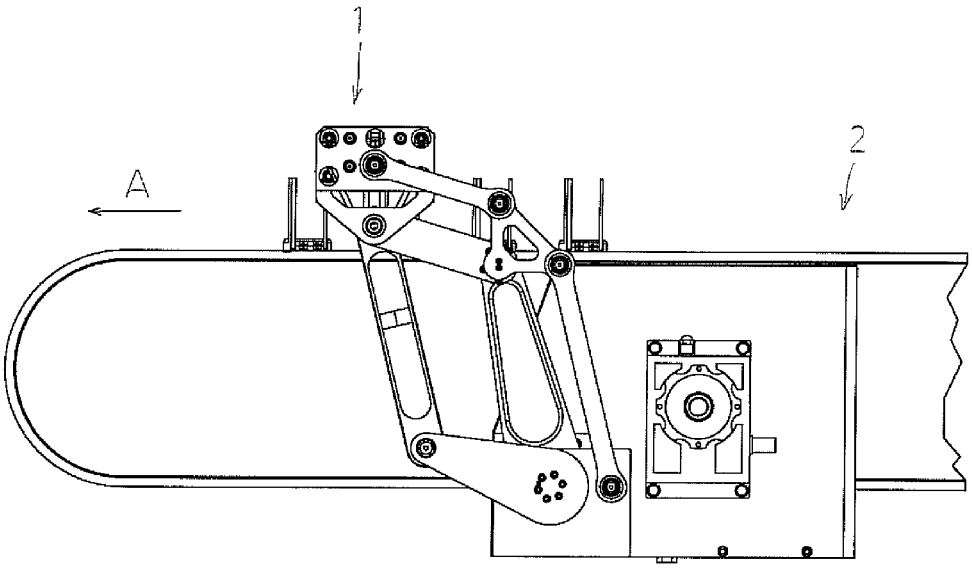
FIGS. 11, 12, 13 are respectively a lateral view, a front view and a perspective view of the apparatus of the present invention, in a fourth operating step which concludes an operating cycle of the apparatus.
Figure 12:
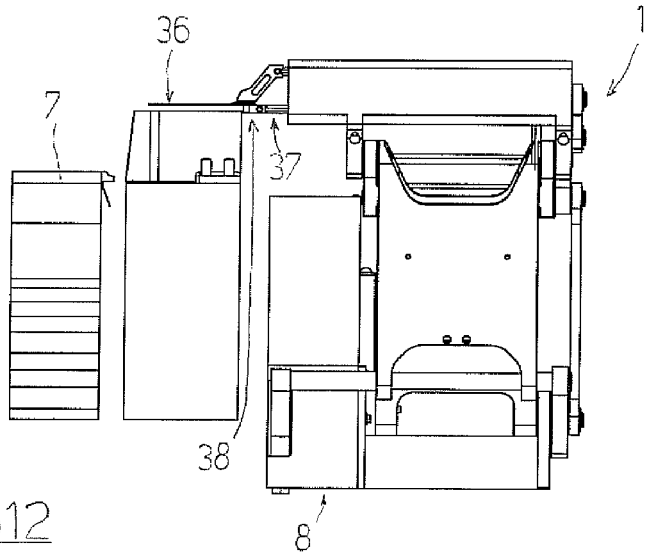
Figure 13:
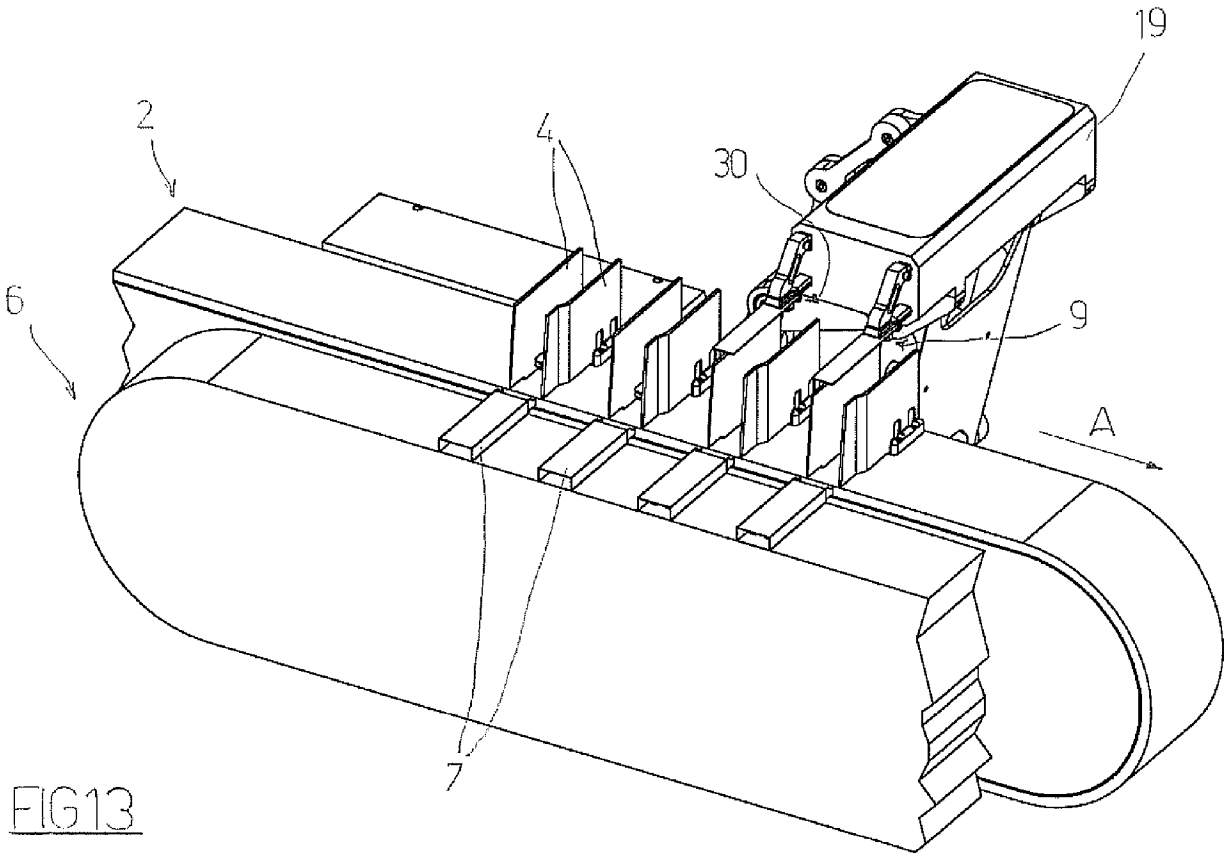

Lastly, the apparatus (1) is moved such that the first abutting blade (36) and the first thrust plate (9) pass over (FIGS. 11-13, fourth operating step) the pair of lateral walls (4) between which the pair of blister packs (3) was previously housed, now inserted into the box (7), and move into a position corresponding to the first operating step such as to introduce a further pair of blister packs (3) internally of an empty box (7). Thus a new operating cycle for the apparatus (1) begins.

In the illustrated embodiment in the figures, the apparatus (1) further comprises: a second thrust plate (30) for pushing at least an article (3) internally of a box (7); a second abutting blade (31) (FIG. 10) for entering at least partially into the box (7) and supplying an upper abutment for facilitating entry of the article (3) into the box (7); a third linear motor (not visible in the accompanying figures) which is housed internally of the fifth member (19); a fourth linear motor (33) which is housed internally of the fifth member (19); a third rod (34) which is fixed to the second thrust plate (30) and which is moved by the third linear motor to move in alternating motion in a horizontal and perpendicular direction to the advancement direction; a fourth rod (35), fixed to the second abutting blade (31) and which is moved by the fourth linear motor (33) (FIG. 7) such as to move alternatingly in a horizontal and perpendicular direction to the advancement direction.

The above considerations relating to the functioning of the apparatus (1) are also valid in reference to the present embodiment, since the fifth member (19) can also house a greater number of linear motors such as to move the abutting blades and thrust plates with the aim of contemporaneously introducing several pairs of blister packs (3) internally of corresponding empty boxes (7).

The above has been described by way of non-limiting example, and any constructional variants are understood to fall within the protective scope of the present technical solution, as claimed in the following.

The invention claimed is:

1. An apparatus for inserting articles internally of boxes, which apparatus is operable in synchrony with a first conveyor and a second conveyor, the apparatus comprising: a frame positionable by a side of the first conveyor which moves articles in an advancement direction and in a horizontal advancement direction, with the second conveyor arranged by a side of the first conveyor; which moves boxes in a same advancement direction as the first conveyor a first thrust plate for pushing at least an article into a box; a first abutting blade for at least partially entering the box and providing an upper abutment for facilitating insertion of the article into the box; a first member hinged to the frame at a first hinge axis; a second member hinged to the first member at a second hinge axis; a third member hinged to the frame at the first hinge axis; a fourth member hinged to the second member at a third hinge axis and to the third member at a fourth hinge axis; the first member, the second member, the third member and the fourth member defining a first four-bar linkage; a fifth member hinged to the fourth member and to the second member at the third hinge axis; a sixth member hinged to the fifth member at a fifth hinge axis; a seventh member hinged to the sixth member at a sixth hinge axis and to the fourth member and to the third member at the fourth hinge axis; the fourth member, the fifth member, the sixth member and the seventh member defining a second four-bar linkage; an eighth member hinged to the frame at a seventh hinge axis and to the seventh member at an eighth hinge axis; the first hinge axis, the second hinge axis, the third hinge axis, the fourth hinge axis, the fifth hinge axis, the sixth hinge axis, the seventh hinge axis and the eighth hinge axis being horizontal and perpendicular to the advancement direction; the apparatus being positionable with respect to the first conveyor such that the second member is downstream of the third member with respect to the advancement direction; a first linear motor borne by the fifth member; a second linear motor borne by the fifth member; a first rod fixed to the first thrust plate and being moved by the first linear motor so as to move with an alternating motion in a horizontal and perpendicular direction to the advancement direction; a second rod fixed to the first abutting blade and being moved by the second linear motor in order to move with an alternating motion in a horizontal and perpendicular direction to the advancement direction; the first member and the third member being rotatable to move the fifth member in synchrony with the first conveyor and with the second conveyor and enable movement of the first thrust plate and the first abutting blade respectively by the first linear motor and the second linear motor in order to introduce at least an article internally of the box.

2. The apparatus of claim 1, wherein the first four-bar linkage is a parallelogram linkage.

3. The apparatus of the claim 1, wherein the second four-bar linkage is a parallelogram linkage.

4. The apparatus of claim 1, wherein the fifth member forms a housing and wherein the first linear motor and the second linear motor are housed within the housing.

* * * * *